US006533596B2

(12) United States Patent
Demuth et al.

(10) Patent No.: US 6,533,596 B2
(45) Date of Patent: Mar. 18, 2003

(54) LINEAR DRIVE

(75) Inventors: Stephan Demuth, Benningen (DE); Uwe Gräff, Ostfildern (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/112,524

(22) Filed: Mar. 29, 2002

(65) Prior Publication Data

US 2002/0146939 A1 Oct. 10, 2002

(30) Foreign Application Priority Data

Apr. 10, 2001 (DE) ..... 201 06 298 U

(51) Int. Cl.[7] ..... H01R 17/18
(52) U.S. Cl. ..... 439/320
(58) Field of Search ..... 439/320, 319, 439/322, 323

(56) References Cited

U.S. PATENT DOCUMENTS 5,378,882 A * 1/1995 Gong et al. ..... 235/462.45
5,662,022 A * 9/1997 Stoll ..... 92/88

FOREIGN PATENT DOCUMENTS

| | | |
|---|---|---|
| EP | 0 095 267 | 11/1983 |
| FR | 2 794 236 | 12/2000 |
| JP | 02-259403 | 10/1990 |

* cited by examiner

*Primary Examiner*—Lynn Field
*Assistant Examiner*—Phuong Dinh
(74) *Attorney, Agent, or Firm*—Hoffmann & Baron, LLP

(57) ABSTRACT

A linear drive with a having a housing cover arranged on at least one terminal region. In the housing position detecting means are arranged. At the laterally aligned outer face of the housing cover an electromechanical connection means is provided for detachable connection of an electrical conductor arrangement leading toward the linear drive from the outside to the position detecting means. The electromechanical connection means is accommodated in a completely sunk manner in the housing cover without standing proud of the laterally aligned outer face.

11 Claims, 1 Drawing Sheet

LINEAR DRIVE

BACKGROUND OF THE INVENTION

The invention relates to a linear drive comprising a housing, a housing cover arranged on at least one terminal region, position detecting means arranged in the housing and an electromechanical connection means placed at the laterally aligned outer face of the housing cover, said connection means serving for the detachable connection of an electrical conductor arrangement leading from the outside to the linear drive from the side.

THE PRIOR ART

Fluid operated linear drives as a rule comprise an elongated housing having housing covers arranged at the ends and a piston accommodated in the housing, said piston being able to be caused to perform a linear movement by being acted upon by fluid. The linear motion may be transmitted and employed to drive some other instrumentality using a force transmitting dog. In order to detect one or more positions of the piston the linear drive is fitted with position detecting means, which by way of an electrical conductor arrangement, normally in the form of a cable, can be connected with an external electronic evaluating means.

In the case of a linear drive as disclosed in the German patent publication (utility model) 20,014,353.0 the position detecting means are accommodated in the wall of the housing of the linear drive. The making of electrical contact takes place from the side of the linear drive at a housing cover, from which there extends a connection unit with position detecting means.

SHORT SUMMARY OF THE INVENTION

One object of the present invention is to provide a linear drive which has even more compact dimensions and is extremely simple to clean.

In order to achieve these and/or other objects appearing from the present specification, claims and drawings, in the present invention the electromechanical connection means is accommodated in a completely sunk manner in the housing cover without standing proud of the laterally aligned outer face.

While in the case of the prior art electromechanical connection means stands proud to the side past the housing cover in the invention it is now completely sunk into the housing cover. The transverse dimensions of the linear drive are hence substantially reduced. Furthermore, cleaning becomes a substantially simpler task so that the linear drive is well suited for applications in the foodstuff industry.

Further advantageous developments of the invention are defined in the claims.

The electromechanical connection means is preferably provided with plug contact elements for making electrical contact of a connection part connected with the electrical conductor arrangement. The plug contact elements are preferably designed in the form of plug pins, the connection part to be connected being in the form of a jack.

The parts serving for mechanically securing a connection part connected with the electrical conductor arrangement, of the electromechanical connection means preferably comprise a screw thread, particularly convenient design having a female screw thread. The latter may be integrated in the housing cover in a particularly simple fashion. Furthermore, thread sizes under M8 may be simply employed in a relatively simple manner.

In principle it would be possible for the electromechanical connection means to be mounted in the housing cover so as to be sunk in relation to the lateral outer face of the housing cover. More particularly for reasons of ease of cleaning it is however to be recommended to provide for installation so as to be flush with the lateral outer face of the housing cover.

The position detecting means may for instance be constituted by a position sensor. A design using a displacement measuring system would however also be possible.

Preferably the linear drive is in the form of a fluid operated one, a piston able to be driven by fluid force being arranged in the housing. The piston is provided with actuating means, which are capable of operating the position detecting means without making physical contact.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENTS OF THE INVENTION

Figure 2:
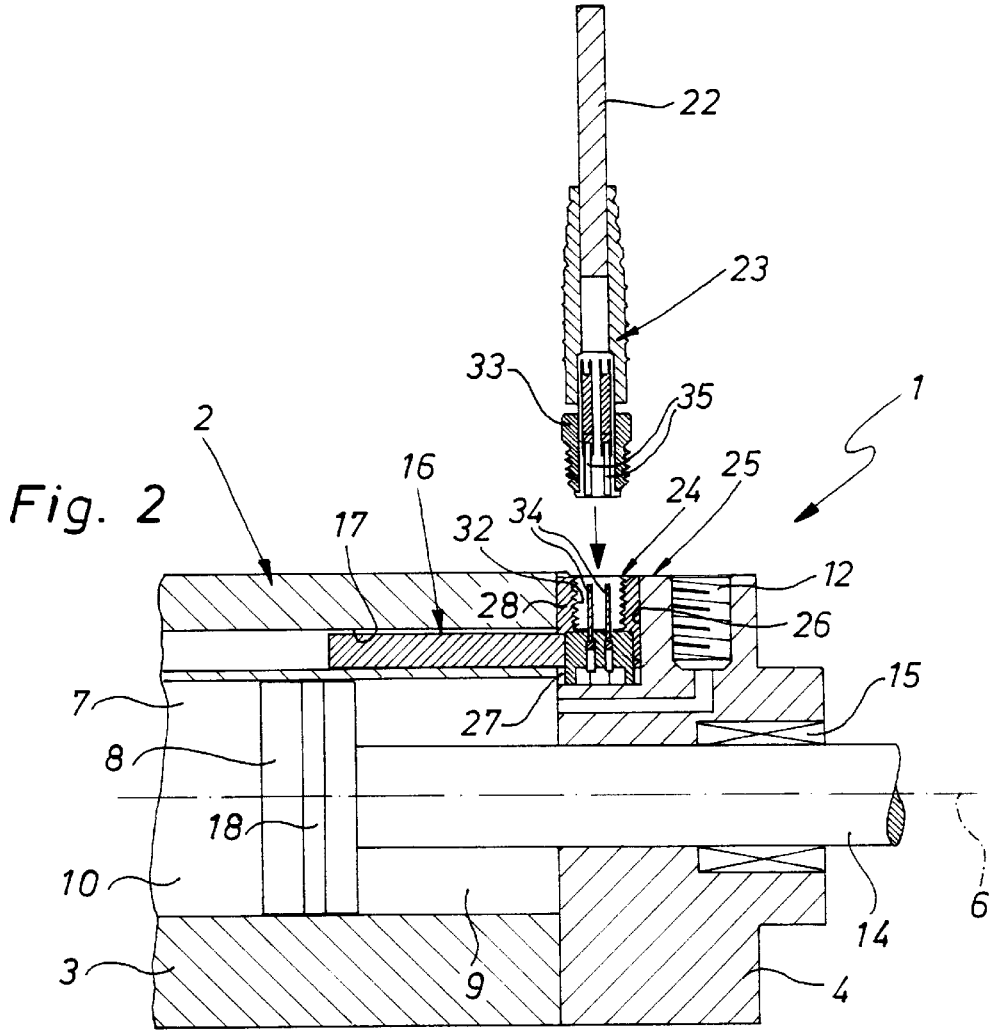
FIG. 2 shows a terminal or end region of the linear drive of FIG. 1 as viewed in a longitudinal section on the line II—II.

In the drawing the reader will see a fluid operated linear drive 1, which has an elongated housing 2, said housing having a tubular middle part 3 and two housing covers 4 and 5 arranged at the ends on the middle part 3.

In the interior of the housing there is a piston receiving space 7 which extend in the direction of the longitudinal axis 6 of the housing 2. To the side it is delimited by the middle part 3 and at the end (terminally) it is delimited by the two housing covers 4 and 5.

The piston accommodating space 7 is divided by a piston 8, which runs in it, axially into two working spaces 9 and 10. Each working space communicates with a fluid duct 12 and 13 extending in the adjacent housing cover 4 and 5, and by way of such fluid duct compressed air or some other fluid pressure actuating medium may be supplied or let off in order to cause said piston 8 to shift linearly in the one or the other direction.

The linear movement of the piston 8 may be transmitted to some point outside the housing 2 by means of a dog 14 kinematically coupled with the piston 8. This means that any desired component can be moved and/or positioned. The linear drive 1 of the embodiment of the invention is designed in the form of a power cylinder, the dog or force transferring part 14 being in the form of a piston rod permanently connected with the piston 8, such rod extending through at least one of the housing covers 4 in a sealing manner. A guide means arranged on the housing cover 4 and a sealing means are indicated diagrammatically at 15.

The linear drive is provided with position detecting means 16, which are in a position to detect one or more positions of the piston 8. In the embodiment there are two sets of such position detecting means 16 and respectively associated with one of the housing covers 4 and 5 in order to detect the terminal position of the piston 8 adjacent for the housing cover 4 or 5. As an alternative the position detecting means 16 could also be so designed that respectively several axial positions of the piston 8 could be detected, it then being more particularly a design in the form of a displacement measuring system with which, at least along a certain distance, each instantaneous position of the piston 8 could be detected.

The following further description of the invention will be with reference to the position detecting means 16 associated with the housing cover 4 with the dog 14 extending through it, the position detecting means 16 for the opposite housing cover 5 being similar in form and arranged in a similar manner. Moreover, it would be readily possible to arrange position detecting means 16 only at one housing cover 4 and 5.

The position detecting means 16 are completely accommodated in the interior of the housing 2. In the working example they are constituted by a rod-like position sensor, which is inserted from the terminal side facing the housing's cover 4, of the middle part 3 into a receiving well 17 in this middle part 3.

As regards details in the working embodiment illustrated the position detecting means 16 comprise a rod-like housing in which detection means are accommodated, said means not being illustrated in the drawing in detail. The detecting means may be operated by actuating means 18 on the piston 8 without making physical contact and more particularly when same come into a position opposite to and radially within the detection means.

The actuating means 18 in the embodiment comprise an annular permanent magnet element, the detection means being in the form of a so-called Reed switch, which is responsive to the magnetic force. However other designs of the position detecting means 16 and of the actuating means 18 are possible.

Figure 1:
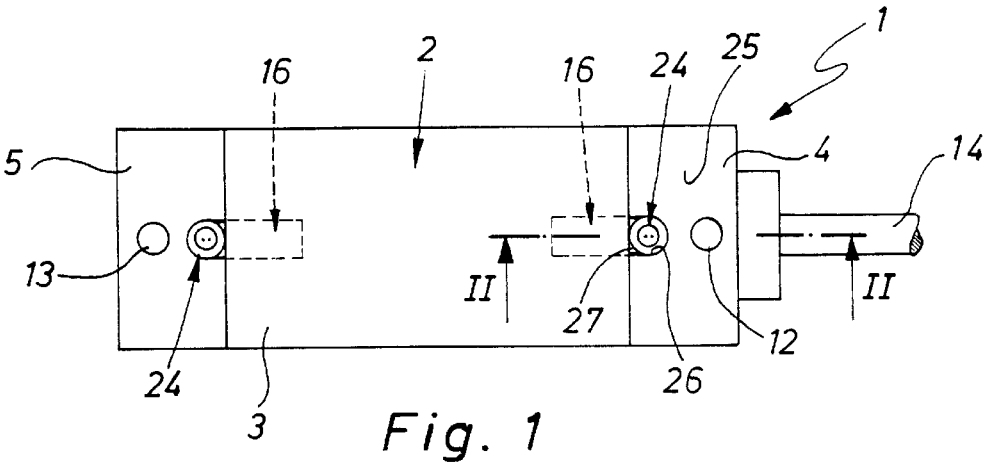
FIG. 1 is a diagrammatic representation of the linear drive of the invention in a side elevation.

On actuation of the position detecting means 16 one or more sensors signals are produced, which are supplied by way of an electrical conductor arrangement 22 to an electronic evaluating unit, not illustrated in detail. The electrical conductor arrangement 22 comprises one or more electrical conductors, there being two thereof in the embodiment, and is more especially designed like a cable. In FIG. 1 one terminal region of the electrical conductor arrangement 22 will be seen, on which an electromechanical connection part 23 is arranged.

The making of electrical contact between the conductor arrangement 22 and the position detecting means 16 or, respectively, the detection means thereof takes place by way of an electromechanical connection means associated with the position detecting means 16. The means 24 is placed at the laterally aligned outer face 25 of the housing cover 4 and is so designed that the flexible electrical conductor arrangement 22 may be connected from the side of the linear drive 1 in a detachable fashion. Connection takes place using the connection part 23.

A significant advantage of the arrangement described is that the electromechanical connection means 24 is accommodated completely sunk in the housing cover 4 without standing proud of the laterally facing outer face 25. Here a preferably surface-flush installation is provided, this offering the advantage that no well is produced in which during later use dirt could collect when the connection part 23 is connected.

The electromechanical connection means 24 is in the working example designed in the form of a common subassembly together with the position detecting means 16. Therefore it is possible for common, uniform assembly to take place on the linear drive 1. It is more especially possible to design the housing of the position detecting means 16 and the housing of the electromechanical connection means 24 integrally.

The electromechanical connection means 24 is accommodated in a receiving well or recess 26 in the housing cover 4, and this well is open toward the laterally aligned outer face 25 of the housing cover 4. The well has an opening 27 directed toward the middle part 3 and through such opening the position detecting means 16 can extend.

In the working embodiment illustrated the electromechanical connection means 24 possesses a jack-like housing part 28 seated over the receiving well 26 and such part 28 is provided with a screw thread 32 in the form of an internal thread in its inner periphery. As compared with a design with an external thread the selected design permits a simpler form of production and assembly, while having extremely compact dimensions.

The connection means 23 provided on the electrical conductor arrangement 22 is provided with a rotatable screw element 33, which has an external screw thread, by means of which it may be screwed into the screw thread 32 of the connection means 24 from the outside in order to produce the desired mechanical attachment.

For the obtaining electrical contact the connection means 24 integrated in the housing cover 4 is provided with plug contact elements 34 inside the housing 29, such contact elements being able to be inserted into jacks 35 provided on the connection part 23. It will be clear that the arrangement of pin-like plug contact elements 34 and complementary jacks 35 may be mechanically reversed.

The connection of the connection part 23 to the connection means 24 is a combined plugging and screwing operation. The electrical connection is produced by a plugging operation whereas the mechanical connection is produced by screwing.

Instead of the electrical plug contact elements it is also possible to have spring loaded contact means which do not interlock.

The construction describe renders possible the production of a screw thread 32 on the electromechanical connection means 24 having a screw with a size less than M8. For instance, an M6 thread may be utilized. This means that there is the possibility of fitting relatively small linear drives 1 with the device of the invention.

What is claimed is:

1. A linear drive comprising:

a drive housing including a well formed in a side wall thereof, a drive housing cover arranged on at least one terminal region of the housing and having a recess formed therein, the recess having an opening communication with the well in the drive housing, a position detecting means for detecting the position of a piston including a housing arranged in the drive housing, the position detecting means being insertable into the well from a side of the housing facing the housing cover, an electromechanical connection means including a housing placed at a laterally aligned outer face of the housing cover, said connection means serving for the detachable connection of an electrical conductor arrangement leading from the outside toward the linear drive from the side, to the position detection means, wherein the electromechanical connection means is accommodated in a completely sunk manner in the housing cover without standing proud of the laterally aligned outer face, and the housing of the position detecting means being integrally formed with the housing of the electromechanical connection means, wherein the connection means is disposed within the recess of the housing cover, and the position detecting means is disposed in the well of the drive housing.

2. The linear drive as set forth in claim 1, wherein the electromechanical connection means possesses plug contact elements for electrically contacting a connection part connected with the electrical conductor arrangement.

3. The linear drive as set forth in claim 1, wherein the electromechanical connection means possesses a screw thread for the mechanical attachment of a connection part connected with the electrical conductor arrangement.

4. The linear drive as set forth in claim 3, wherein the screw thread is an internal screw thread.

5. The linear drive as set forth in claim 4, wherein the screw thread has a size of under M8 and more particularly is an M6 screw thread.

6. The linear drive as set forth in claim 1, wherein the electromechanical connection means is arranged so as to be flush with the lateral outer face of the drive housing cover.

7. The linear drive as set forth in claim 1, wherein the connection means and the position detecting means are designed to form a common uniform structure.

8. The linear drive as set forth in claim 1, wherein the position detecting means are constituted by a position sensor or a displacement measuring system.

9. The linear drive as set forth in claim 1, comprising a piston able to move linearly in the drive housing, such piston having actuating means for activating the position detecting means.

10. The linear drive as set forth in claim 1, in the form of a fluid operated linear drive.

11. A linear drive comprising:

a drive housing including a well formed in a side wall thereof;

a drive housing cover arranged on at least one terminal region of the housing and having a recess formed therein, the recess having an opening communicating with the well in the drive housing;

a position detector including a housing arranged in the drive housing, the position detector being insertable into the well from a side of the housing facing the housing cover, and the housing of the position detector being integrally formed with the housing of the connector; and a connector including a housing disposed in the housing cover, the connector being in electrical communication with the position detector and adapted to be connected to an electrical conductor arrangement, wherein the connection is disposed in a completely sunk manner in the recess of the housing cover without standing proud of the laterally aligned outer face.

* * * * *